US009696072B2

(12) United States Patent
McMasters et al.

(10) Patent No.: US 9,696,072 B2
(45) Date of Patent: Jul. 4, 2017

(54) SYSTEM AND METHOD FOR CALCULATING TEMPERATURE IN AN AIR CONDITIONING SYSTEM

(71) Applicants: Bosch Automotive Service Solutions LLC, Warren, MI (US); Robert Bosch GmbH, Stuttgart (DE)

(72) Inventors: Mark W. McMasters, Owatonna, MN (US); Dylan M. Lundberg, Lonsdale, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 318 days.

(21) Appl. No.: 14/542,737

(22) Filed: Nov. 17, 2014

(65) Prior Publication Data

US 2015/0159930 A1 Jun. 11, 2015

Related U.S. Application Data

(60) Provisional application No. 61/912,317, filed on Dec. 5, 2013.

(51) Int. Cl.
*F25B 45/00* (2006.01)

(52) U.S. Cl.
CPC ..... *F25B 45/00* (2013.01); *F25B 2345/005* (2013.01)

(58) Field of Classification Search
CPC ..... F25B 45/00; F25B 2345/001; F25B 2345/003; F25B 2345/005; F25B 2345/006; F25B 2345/007
USPC ..... 62/149
See application file for complete search history.

(56) References Cited

U.S. PATENT DOCUMENTS

2013/0008192 A1 1/2013 McMasters et al.
2013/0298995 A1 11/2013 McMasters et al.
2014/0182312 A1 7/2014 Lundberg et al.

FOREIGN PATENT DOCUMENTS

EP 2420766 A2 2/2012

OTHER PUBLICATIONS

Europeaon Search Report and Written Opinion corresponding to European Patent Application No. 14195279.6, mailed on Apr. 17, 2015 (6 pages).

*Primary Examiner* — Marc Norman
(74) *Attorney, Agent, or Firm* — Maginot Moore & Beck LLP

(57) ABSTRACT

A method of operating a refrigerant service system to charge an air conditioning circuit includes pre-charging a predetermined pre-charge quantity of refrigerant into the air conditioning circuit, determining an average temperature in the air conditioning circuit based upon a pressure in the air conditioning circuit after pre-charging the air conditioning circuit, determining a charge compensation value based upon the determined average temperature in the air conditioning circuit, and charging the air conditioning circuit with a quantity of refrigerant based upon the charge compensation value.

20 Claims, 5 Drawing Sheets

SYSTEM AND METHOD FOR CALCULATING TEMPERATURE IN AN AIR CONDITIONING SYSTEM

CLAIM OF PRIORITY

This application claims the benefit of priority to co-pending U.S. provisional application No. 61/912,317, entitled "System and Method for Calculating Temperature in an Air Conditioning System," which was filed on Dec. 5, 2013, the disclosure of which is incorporated herein by reference in its entirety.

TECHNICAL FIELD

This disclosure relates generally to refrigeration systems, and more particularly to refrigerant recharging systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant included therein is periodically replaced or recharged.

Portable carts, also known as recover, recycle, recharge ("RRR") refrigerant service carts or air conditioning service ("ACS") units, are used in connection with servicing refrigeration circuits, such as the air conditioning unit of a vehicle. The portable machines include service hoses coupled to the refrigeration circuit to be serviced. A vacuum pump and compressor operate to recover refrigerant from the vehicle's air conditioning unit, flush the refrigerant, and subsequently recharge the system from a supply of either recovered refrigerant and/or new refrigerant from a refrigerant tank.

Currently available processes for recharging air conditioning systems typically include connecting the recharging unit to an air conditioning ("A/C") system and transferring the refrigerant from a refrigerant tank of the recharging unit to the A/C system. A/C systems in automotive applications continue to get smaller in order to reduce the amount of refrigerant needed for efficient operation. The accuracy at which the A/C system is refilled is increasingly important in smaller A/C systems. Current industry standards for A/C service require a refill accuracy of +/−15 grams, but even tighter tolerances are desirable.

When the temperatures of the ACS machine and the system being charged are equal to ambient temperature, accurate charging is much easier. However, when temperatures vary, the refrigerant will migrate to the coldest area. For example, when charging a vehicle that is hot, the refrigerant will condense in the service hoses rather than traveling into the refrigerant system. In current ACS units, the amount of refrigerant remaining in the service hoses or fittings is difficult to accurately determine. Therefore, the refrigerant trapped in the service hoses is not accurately accounted for in the determination of the amount of refrigerant charged into the A/C system.

Some previous ACS units address the problem by performing a dynamic hose compensation based on temperature differentials between the refrigerant temperature and the ambient temperature. The ambient temperature, however, may not be a good approximation for the A/C system temperature when the vehicle in which the A/C system has been running or has been parked at a location that is different from where the ambient temperature is recorded. As a result, the known dynamic hose compensation does not accurately account for the temperature of the A/C system.

Additionally, the actual temperature of the A/C system is difficult to determine since the A/C system typically does not have temperature sensors to measure the system temperature. Furthermore, even if the temperature were determined at a location of the A/C system, some components in the A/C system often have differing temperatures due to proximity to components within the vehicle that transfer heat to the components of the A/C system or due to the A/C system being previously active, and therefore generating colder areas within the system.

In view of the above issues, improvements in determining the temperature in an A/C system to increase the precision of recharging the A/C system are desirable.

SUMMARY

In a first embodiment according to the disclosure, a method of operating a refrigerant service system to charge an air conditioning circuit comprises pre-charging a predetermined pre-charge quantity of refrigerant into the air conditioning circuit, determining an average temperature in the air conditioning circuit based upon a pressure in the air conditioning circuit after pre-charging the air conditioning circuit, determining a charge compensation value based upon the determined average temperature in the air conditioning circuit, and charging the air conditioning circuit with a quantity of refrigerant based upon the charge compensation value. The method advantageously enables the refrigerant service system to compensate for the quantity of refrigerant in the air conditioning circuit based upon a calculated temperature in the circuit.

In another embodiment according to the disclosure, the method further includes obtaining a circuit charge quantity for the air conditioning circuit.

In a further embodiment, the determination of the average temperature further comprises obtaining a pressure reading from a pressure transducer fluidly connected to the air conditioning circuit, and determining the average temperature in the air conditioning circuit based upon the pre-charge quantity of refrigerant, the circuit charge quantity, the pressure reading obtained from the pressure transducer, and baseline data stored in memory. The method enables a more precise determination of the temperature in the air conditioning circuit using the pressure in the air conditioning circuit, pre-charge quantity, circuit charge quantity, and baseline data.

In yet another embodiment according to the disclosure, the pre-charging further comprises operating a solenoid valve fluidly connected to and positioned between a refrigerant storage vessel and the air conditioning system to transfer the pre-charge quantity of refrigerant to the air conditioning circuit, and waiting for pressure to stabilize in the air conditioning circuit. The pre-charging of the air conditioning circuit is advantageously performed accurately and the pressure in the circuit is precisely determined.

In some embodiments, the charging of the air conditioning circuit further comprises determining the quantity of refrigerant as the sum of the standard charge quantity and the charge compensation value, and operating the solenoid valve to charge the air conditioning circuit from the refrigerant storage vessel. The charging of the air conditioning circuit is advantageously performed precisely to the desired charge for the system.

In a further embodiment according to the disclosure, the determination of the average temperature further comprises obtaining a first weight reading from a scale configured to sense a mass of a refrigerant storage vessel from which the pre-charge quantity is transferred prior to the pre-charging, obtaining a second weight reading from the scale after the pre-charging, determining an actual pre-charged quantity of refrigerant into the air conditioning system based upon the difference between the first and second weight readings, obtaining a pressure reading from a pressure transducer fluidly connected to the air conditioning circuit, and determining the average temperature in the air conditioning circuit based upon the actual pre-charged quantity of refrigerant, the pressure reading obtained from the pressure transducer, and baseline data stored in memory from a baseline test. Advantageously, the actual pre-charged quantity is used in the determination of the temperature, enabling a more accurate determination of the temperature. Additionally, the temperature is determined without need for obtaining the circuit charge quantity.

In another embodiment, the method further comprises obtaining a circuit charge quantity for the air conditioning circuit, and the determination of the average temperature in the air conditioning circuit is further based upon the circuit charge quantity. The determination of the temperature can advantageously be performed more precisely.

In one embodiment, the baseline data includes a temperature value, a charge mass value, and a pressure value recorded from the baseline test. The baseline test data enables accurate determination of the current temperature in the air conditioning circuit by using the Ideal Gas Law.

In another embodiment, the charge compensation value is a compensation for an estimated quantity of refrigerant remaining in service hoses connecting the refrigerant service system to the air conditioning circuit after charging the air conditioning system. The method advantageously enables compensation for the refrigerant remaining in the service hoses, improving the accuracy of the determination of the refrigerant actually charged to the air conditioning circuit.

In a second embodiment according to the disclosure, a refrigerant service system comprises a refrigerant storage vessel, a hose connection configured to connect the refrigerant storage vessel to an air conditioning circuit, and a controller. The controller is configured to operate the refrigerant service system to pre-charge a predetermined pre-charge quantity of refrigerant into the air conditioning circuit from the refrigerant storage vessel, determine an average temperature in the air conditioning circuit based upon a pressure in the air conditioning circuit after pre-charging the air conditioning circuit, determine a charge compensation value based upon the determined average temperature in the air conditioning circuit, and charge the air conditioning circuit from the refrigerant storage vessel with a quantity of refrigerant based upon the charge compensation value. The refrigerant service system advantageously compensates for the quantity of refrigerant in the air conditioning circuit based upon a calculated temperature in the circuit.

In a further embodiment, the controller is further configured to obtain a circuit charge quantity for the air conditioning circuit.

In yet another embodiment, the refrigerant service system further comprises a pressure transducer fluidly connected to and configured to generate a pressure reading corresponding to a pressure in the air conditioning circuit. The controller is further configured to obtain the pressure reading from the pressure transducer and determine the average temperature in the air conditioning circuit based upon the pre-charge quantity of refrigerant, the circuit charge quantity, the pressure reading obtained from the pressure transducer, and baseline data stored in memory. The refrigerant storage system advantageously performs a precise determination of the temperature in the air conditioning circuit using the pressure in the air conditioning circuit, pre-charge quantity, circuit charge quantity, and baseline data.

In some embodiments, the refrigerant service system further comprises a solenoid valve fluidly connected to and positioned between the refrigerant storage vessel and the hose connection. The controller is configured to pre-charge the air conditioning circuit by operating the solenoid valve to transfer the pre-charge quantity of refrigerant to the air conditioning circuit and waiting for the pressure in the air conditioning circuit to stabilize. The pre-charging of the air conditioning circuit is advantageously performed accurately and the pressure in the circuit is precisely determined.

In another embodiment, the controller is further configured to charge the air conditioning circuit by determining the quantity of refrigerant as a sum of the standard charge quantity and the charge compensation value, and operating the solenoid valve to charge the air conditioning circuit from the refrigerant storage vessel. The charging of the air conditioning circuit is advantageously performed precisely to the desired charge for the system.

In yet another embodiment, the refrigerant service system further comprises a scale configured to sense a mass of the refrigerant storage vessel and a pressure transducer fluidly connected to and configured to generate a pressure reading corresponding to a pressure in the air conditioning circuit. The controller is further configured to determine the average temperature by obtaining a first weight reading from the scale prior to the pre-charging, obtaining a second weight reading from the scale after the pre-charging, determining an actual pre-charged quantity of refrigerant into the air conditioning system based upon the difference between the first and second weight readings, obtaining the pressure reading from the pressure transducer, and determining the average temperature in the air conditioning circuit based upon the actual pre-charged quantity of refrigerant, the pressure reading obtained from the pressure transducer, and baseline data stored in memory from a baseline test. Advantageously, the controller uses the actual pre-charged quantity in the determination of the temperature, enabling a more accurate determination of the temperature. Additionally, the temperature is determined without need for obtaining the circuit charge quantity.

In one embodiment, the controller is further configured to obtain a circuit charge quantity for the air conditioning circuit and to determine the average temperature in the air conditioning circuit based upon the circuit charge quantity. The determination of the temperature can advantageously be performed more precisely.

In a further embodiment according to the disclosure, the baseline data includes a temperature value, a charge mass value, and a pressure value recorded from the baseline test. The baseline test data enables accurate determination of the current temperature in the air conditioning circuit by using the Ideal Gas Law.

In another embodiment, the charge compensation value is a compensation for an estimated quantity of refrigerant remaining in service hoses connecting the refrigerant service system to the air conditioning circuit after charging the air conditioning system. The refrigerant service system advantageously enables compensation for the refrigerant remaining in the service hoses, improving the accuracy of the determination of the refrigerant actually charged to the air conditioning circuit.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
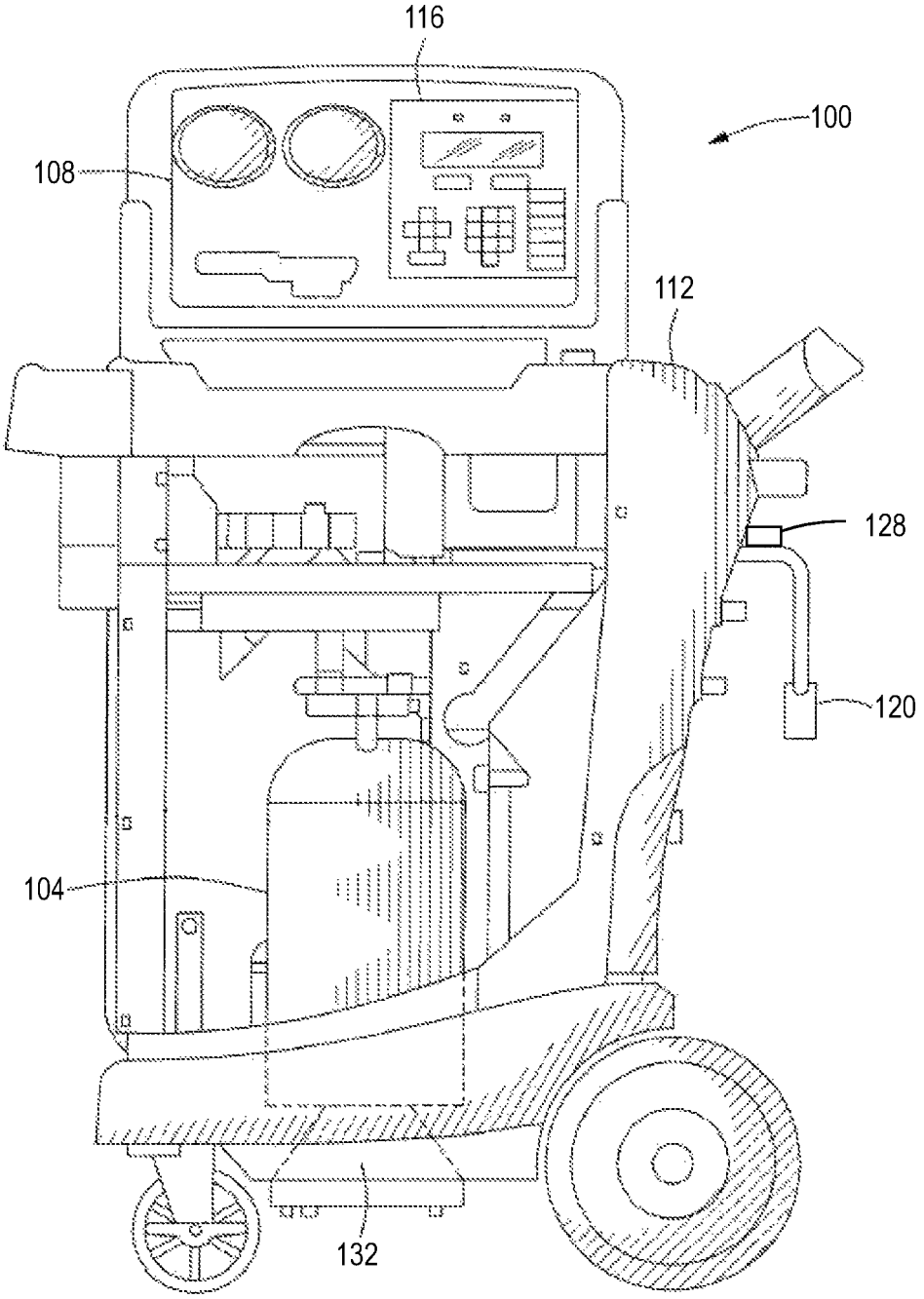
FIG. 1 is an illustration of an air conditioning service ("ACS") machine.

FIG. 1 is an illustration of an air conditioning service ("ACS") unit 100. The ACS unit 100 includes a refrigerant container or internal storage vessel ("ISV") 104, a control module 108, and a housing 112. The exterior of the control module 108 includes an input/output unit 116 for input of control commands by a user and output of information to the user. Hose connections 120 (only one is shown in FIG. 1) protrude from the housing 112 to connect to service hoses that connect to an air conditioning ("A/C") system and facilitate transfer of refrigerant between the ACS unit 100 and the A/C system.

A pressure transducer 128 is positioned on the hose connection 120 and is configured to sense the pressure of the refrigerant in the hose connection 120. In some embodiments, a pressure transducer 128 is located on each hose connection. In other embodiments, the pressure transducer 128 is connected to a hose or conduit within the housing 112 of the ACS unit 100. In further embodiments, the ACS unit 100 has more than one pressure transducer 128, located on the hose connection 120 and/or within the housing 112 of the ACS unit 100, to sense the pressure at multiple locations within the ACS unit 100.

The ISV 104 is configured to store refrigerant for the ACS unit 100. No limitations are placed on the kind of refrigerant that may be used in the ACS unit 100. As such, the ISV 104 is configured to accommodate any refrigerant that is desired to be charged to the A/C system. In some embodiments, the ISV 104 is particularly configured to accommodate one or more refrigerants that are commonly used in the A/C systems of vehicles (e.g., cars, trucks, boats, planes, etc.), for example R-134a, $CO_2$, or R1234yf. The ISV 104 includes an ISV scale 132 configured to sense the weight of the ISV tank 104. In some embodiments, the ACS unit has multiple ISV tanks configured to store different refrigerants. Each independent ISV in one embodiment includes a separate scale. In other embodiments, the independent ISV tanks are all weighed by a single ISV scale.

Figure 2:
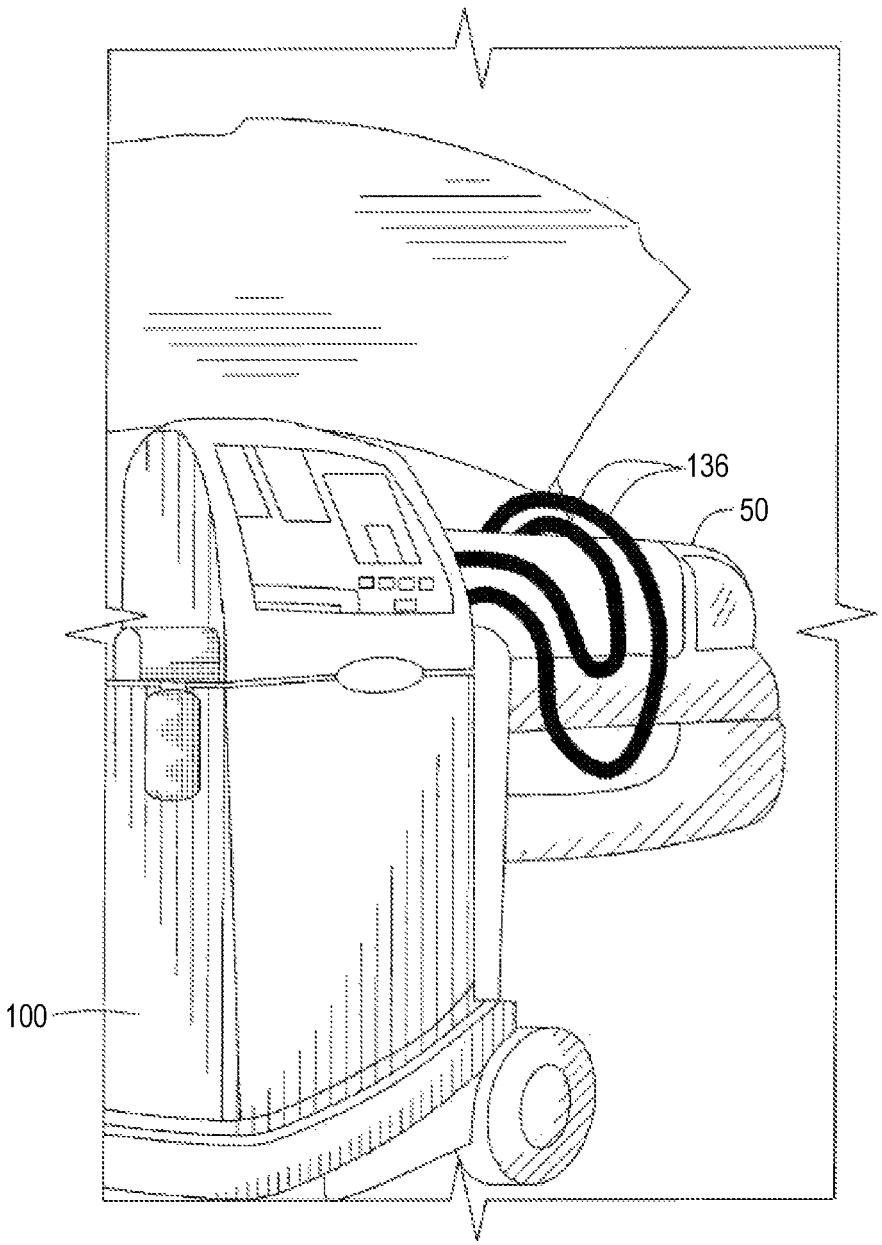
FIG. 2 is an illustration of the ACS machine of FIG. 1 attached to a vehicle.

FIG. 2 is an illustration of a portion of the air conditioning recharging system 100 illustrated in FIG. 1 connected to a vehicle 50. One or more service hoses 136 connect an inlet and/or outlet port of the A/C system of the vehicle 50 to the hose connections 120 (shown in FIG. 1) of the ACS unit 100.

Figure 3:
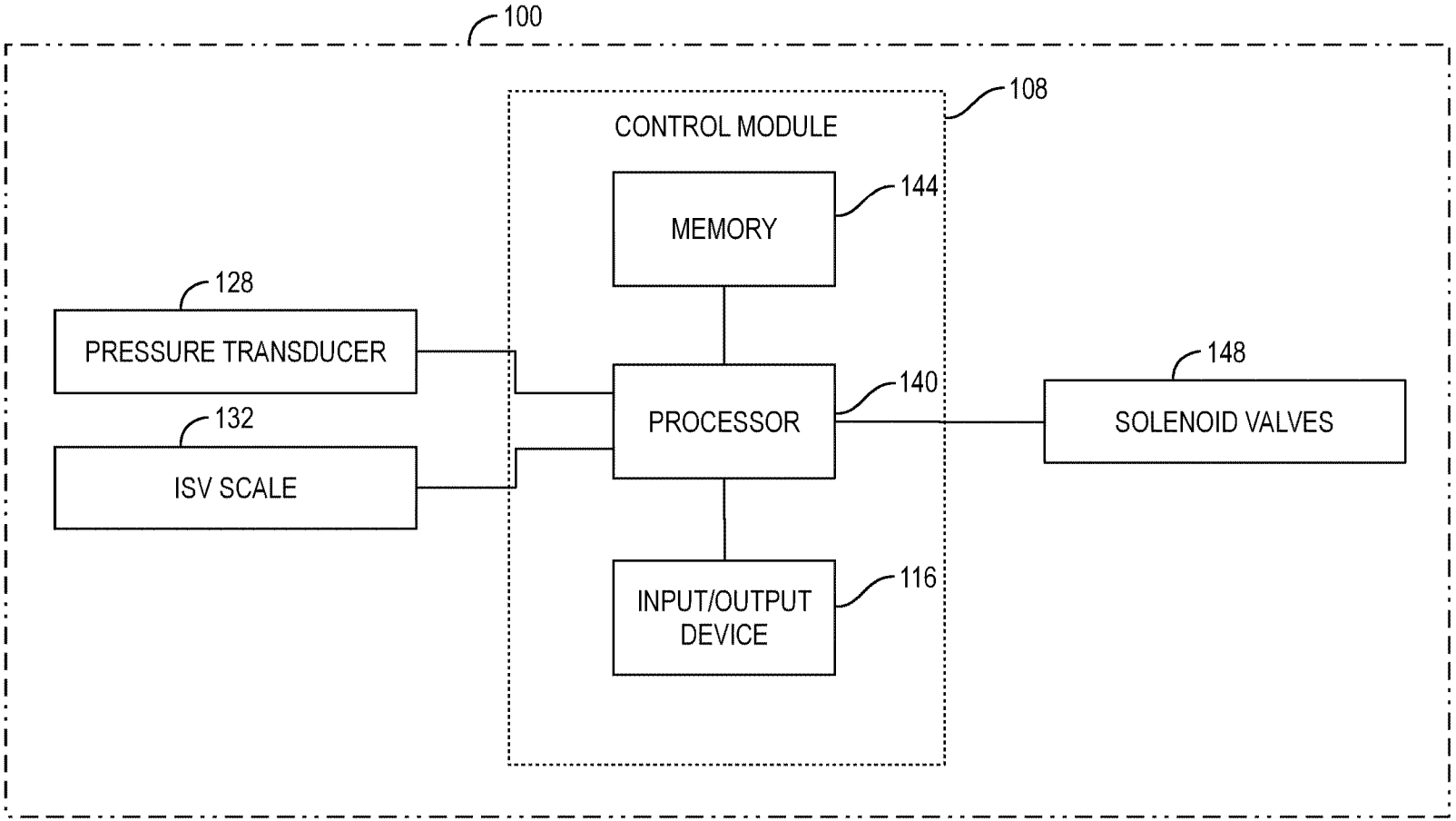
FIG. 3 is a schematic view of the control components of the ACS machine of FIG. 1.

FIG. 3 is a schematic diagram of the control module 108 and the components in the ACS system 100 communicating with the control module 108. Operation and control of the various components and functions of the ACS system 100 are performed with the aid of a processor 140. The processor 140 is implemented with a general or specialized programmable processor that executes programmed instructions. In some embodiments, the processor 140 includes more than one general or specialized programmable processor. The instructions and data required to perform the programmed functions are stored in a memory unit 144 associated with the processor 140. The processor 140, memory 144, and interface circuitry are configured to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The pressure transducer 128 is electrically connected to the processor 140 and is configured to transmit electronic signals representing the sensed pressure in the hose connection 120 to the processor 140. Likewise, the ISV scale 132 is also electrically connected to the processor 140 and is configured to transmit electronic signals representing the sensed mass of the ISV 104 to the processor 140. The signals from the transducer 128 and scale 132 are transmitted when requested by the processor 140 or are sent continuously or on a predetermined basis, such as every 30 seconds, minute, 5 minutes, 15 minutes, 30 minutes, hour, etc.

The signals received by the processor 140 are stored in the memory 144 of the control module 108. The processor 140 transmits signals to operate one or more solenoid valves 148, which open and close to control the flow and amount of refrigerant being charged into the A/C system. The processor 140 is also connected to the input/output device 116 to enable a user to input parameters and activate operating algorithms for the processor 140, and to enable the control module 108 to display information to the user of the ACS unit 100.

Figure 4:
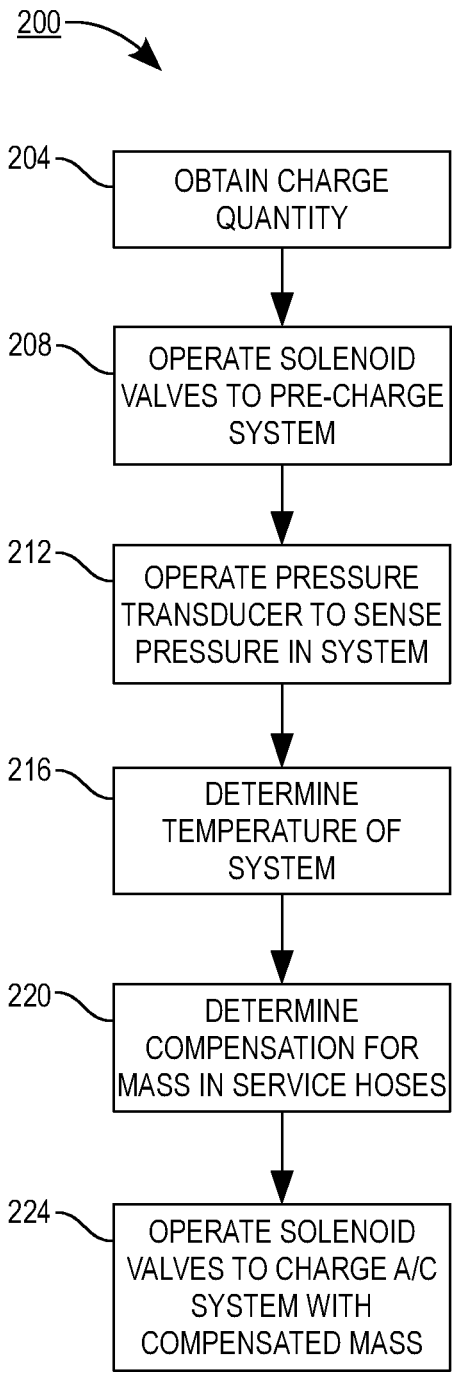
FIG. 4 is a process diagram of a method of performing a recharge operation of an A/C system using a refrigerant mass compensated for the temperature of the A/C system.

FIG. 4 illustrates a method 200 for recharging an A/C system using an ACS unit, such as the ACS unit 100 described above with reference to FIGS. 1-3. The processor 140 is configured to execute programmed instructions stored in the memory 144 to operate the components in the ACS unit 100 to implement the method 200. The method 200 begins with the processor 140 obtaining a charge quantity for the A/C system of the vehicle 50 to which the ACS unit 100 is attached (block 204). In some embodiments, the charge quantity is stored in the memory 144 of the processor 140, and the processor 140 recalls the charge quantity when the user instructs the processor 140, via the input/output unit 116, the type of vehicle or A/C system to which the ACS unit 100 is attached. In other embodiments, the charge quantity is obtained when a user of the ACS unit 100 inputs the year, make, and model of the vehicle 50, or the model number or charge quantity of the A/C system being serviced, into the input/output unit 116.

The processor 140 then operates the solenoid valves 148 of the ACS unit 100 to transfer a pre-charge to the A/C system (block 208). In one embodiment, the quantity of refrigerant pre-charged into the A/C system is a predetermined amount, for example 50 grams. In other embodiments, the pre-charge quantity varies linearly with the charge quantity or capacity for the A/C system obtained at block 204, as will be discussed in further detail below. Once the pre-charge has been transferred to the system, the solenoid valves are closed and the pressure in the system is allowed to stabilize. In some embodiments, the processor 140 waits for approximately 30 seconds for the pressure to stabilize in the A/C system.

Once the pressure has stabilized, the processor 140 receives an electronic signal representing the pressure in the hose connection 120 from the pressure transducer 128. Since the hose connection 120 is connected to the A/C system, and the pressure has been allowed to stabilize, the pressure in the hose connection 120 is representative of the pressure in the vehicle A/C system. Next, the processor 140 determines the average temperature in the system with reference to the pre-charge quantity, the A/C system charge quantity, the pressure sensed by the pressure transducer, and baseline data stored in memory (block 216). A method for determining the temperature in the A/C system will be discussed in detail below with reference to FIG. 5.

After determining the average temperature in the A/C system, a compensation value for the mass of refrigerant remaining in the service hoses 136 is determined (block 220). The compensation for the mass in the service hoses 136 is recalled from an empirically determined table, graph, or equation stored in the memory as a function of the determined average temperature in the A/C system. The processor 140 then operates the solenoid valves 148 to charge the A/C system with the compensated mass such that the charge quantity of the A/C system obtained in block 204 will be retained in the A/C system.

Figure 5:
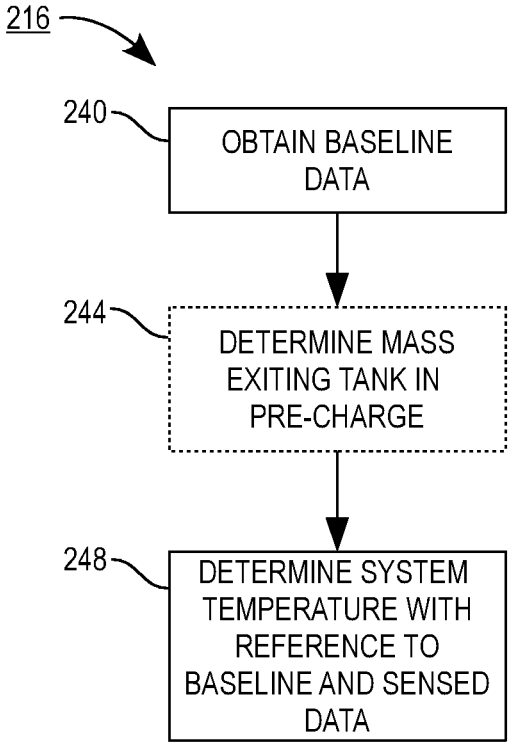
FIG. 5 is a process diagram of a method of determining the temperature of an A/C system to enable compensation of the quantity of mass charged to the A/C system.

FIG. 5 is a process diagram of a method 216 for determining the temperature in the A/C system of the vehicle. The method 216 begins with the processor 140 obtaining baseline data stored in the memory 144. The baseline data recalled includes temperature ($T_1$) and pressure ($P_1$) data recorded during a baseline test performed under known conditions and stored in the memory 144. In various other embodiments, the baseline data recalled from the memory 144 further includes at least one of the system capacity ($X_1$) of the baseline system and the actual mass ($m_1$) of refrigerant transferred from the ISV of the baseline system during the baseline test.

Optionally, the processor 140 is configured to determine the actual mass ($m_2$) of refrigerant transferred from the ISV into the service hoses and the A/C system during the pre-charge (block 244). In order to determine the pre-charge mass ($m_2$), the processor 140 operates the ISV scale 132 to sense the mass of the ISV tank 104 before and after the pre-charge operation. The mass charged into the service hoses and A/C system during the pre-charge operation is the difference between the ISV tank 104 mass before and after the pre-charge operation.

Next, the processor 140 determines the temperature in the system. with reference to the baseline data, the system pressure ($P_2$) sensed in block 212 and the system charge quantity ($X_2$) obtained in block 204 (block 248). The calculation of the temperature is based on the Ideal Gas Law:

$$PV=nRT \quad \text{(Equation 1)}$$

where P is pressure, V is volume, n is the quantity of moles of gas, R is the ideal gas constant, and T is the absolute temperature. The pressure of the system can be sensed by the pressure transducer, and the number moles (n) is equal to the mass (m) divided by the molar mass (M) of the refrigerant.

For a given refrigerant composition and hose size, PV/(nRT) or PV/((m/M)RT), is constant. The ideal gas constant (R) is always the same, and molar mass (M) is constant as long as the same gas is used. Therefore, for a first condition and a second condition:

$$P_1V_1/(m_1T_1)=P_2V_2/(m_2T_2) \quad \text{(Equation 2)}$$

where P is pressure, V is volume, m is mass, and T is temperature, and subscript 1 denotes the first condition and subscript 2 denotes the second condition.

The volume of the system is difficult to accurately determine since the volume depends on the system size, the service hoses used, and any other piping or tubing between the ISV and the A/C system and within the A/C system. Therefore it is assumed that the volume (V) of the system is linearly proportional to the refrigerant capacity of the system (X). A baseline test is performed and the baseline data, denoted with subscript 1, is used for the initial conditions. A second data point is obtained during the pre-charge operation and is denoted with the subscript 2. Substituting refrigerant capacity (X) for volume (V) yields the equation:

$$P_1X_1/(m_1T_1)=P_2X_2/(m_2T_2) \quad \text{(Equation 3)}$$

where $P_1$ is the pressure measured in the baseline test, $X_1$ is the refrigerant capacity of the baseline system, $T_1$ is the measured baseline temperature, $m_1$ is mass removed from the tank in the baseline test, $P_2$ is the pressure measured after the pre-charge, $X_2$ is the refrigerant capacity of the pre-charged system, $T_2$ is the temperature of the pre-charged system, and $m_2$ is the mass removed from the tank during the pre-charge operation.

Solving the above equation for $T_2$, the average temperature in the pre-charged A/C system, yields the equation:

$$T_2=M_1T_1/(P_1X_1)*P_2X_2/m_2 \quad \text{(Equation 4)}$$

Any suitable unit can be used for the pressure, the mass, and the system capacity as long as the same units are used for the baseline test and pre-charge values. The units for temperature must also be the same for the baseline and pre-charge, and must be in absolute temperature, for example in Kelvin or Rankine. $T_1$, $P_1$, $m_1$, and $X_1$ were all determined during the baseline data test, and will be valid for any pre-charge as long as the same refrigerant used in the baseline test is used and service hoses having the same volume as those used in the baseline test are used. In some embodiments, multiple baseline data points are stored in the memory to be recalled based on the particular refrigerant used for a charge and to account for different service hoses.

Since the baseline data does not change for a particular set of service hoses and refrigerant type, the data from the baseline test can be condensed into a baseline refrigerant factor $F_R$, which can be expressed as:

$$F_R=m_1T_1/(P_1X_1) \quad \text{(Equation 5)}$$

The temperature in the pre-charged system is then:

$$T_2=F_R*P_2X_2/m_2 \quad \text{(Equation 6)}$$

In one experimental embodiment, for example, a baseline test was performed, resulting in baseline data of $T_1$=20.34° C. (or 293.49K), $P_1$=4.051 bar, $X_1$=500 grams, and $m_1$=81.83 grams. Using equation 5, the baseline refrigerant factor for the baseline test is 11.85 g-K/(bar-g). As a result, for any subsequent pre-charge operations using the same type of refrigerant and size of hoses as used in the baseline test, the temperature is calculated as:

$$T_2=11.85*P_2X_2/m_2 \quad \text{(Equation 7)}$$

where $T_2$ is in Kelvin, $P_2$ is in bar, and $X_2$ and $m_2$ are in grams.

In some embodiments, it can be assumed that the mass of refrigerant pre-charged into the system to measure pressure is always the same, and is also identical to the mass amount used to find the baseline. Referring back to equation 4 above, if the baseline mass ($m_1$) and pre-charge mass ($m_2$) are assumed to be equal, the mass cancels from the equation. Solving equation 4 for $T_2$, and canceling the mass variable, yields the equation:

$$T_2=T_1/(P_1X_1)*P_2X_2 \quad \text{(Equation 8)}$$

Another baseline refrigerant factor $F_{R2}$, which does not include the baseline charge mass, can then be expressed as:

$$F_{R2}=T_1/(P_1X_1) \quad \text{(Equation 9)}$$

The equation for the pre-charge temperature then becomes:

$$T_2=F_{R2}*P_2X_2 \quad \text{(Equation 10)}$$

Substituting the data obtained from the baseline test discussed above, $T_1$=20.34° C. (or 293.49K), $P_1$=4.051 bar, and $X_1$=500 grams, the temperature of the pre-charge system can be calculated as:

$$T_2=0.1449*P_2X_2 \quad \text{(Equation 11)}$$

where $T_2$ is in Kelvin, $P_2$ is in bar, and $X_2$ is in grams.

As discussed above, in some embodiments, the temperature is determined using a pre-charge amount that is different from the baseline test charge amount. In such a system, the pre-charge amount is determined based on the size of the system (X), and varies linearly in relation to the system size. For example, in one particular embodiment, for the baseline test a 500 gram system is used and the pre-charge amount is 81.83 grams, which, under normal conditions, yields a system pressure of around 4 bar. If the same 81.83 grams is charged into a system that normally contains 1000 grams, the expected pressure would only be 2 bar. However, in this embodiment, the pre-charged amount ($m_2$) is adjusted proportionally with the programmed baseline charge mass ($m_1$) such that the ratios ($m_1/X_1$) and ($m_2/X_2$) are equal. For example, a pre-charge mass ($m_2$) for the system discussed above having 1000 gram capacity is 163.66 grams, maintaining the expected pressure at approximately 4 bar. By operating the system using this pre-charge mass adjustment, the ratios ($m_1/X_1$) and ($m_2/X_2$) are equal and cancel from Equation 4. The temperature calculation is simplified as follows:

$$T_2=T_1*P_2/P_1 \quad \text{(Equation 12)}$$

Factoring the actual mass used in the pre-charge process back into the equation, as discussed above, the equation becomes:

$$T_2=T_1m_1/P_1*P_2/m_2 \quad \text{(Equation 13)}$$

As in the equations used above, a baseline refrigerant factor can be calculated from the values obtained in the baseline test. The baseline refrigerant factor $F_{R3}$ is:

$$F_{R3}=T_1m_1/P_1 \quad \text{(Equation 14)}$$

Substituting the baseline refrigerant factor $F_{R3}$ into Equation 13, the equation for the pre-charge temperature is then:

$$T_2=F_{R3}*P_2/m_2 \quad \text{(Equation 15)}$$

Using the experimental values from the baseline test discussed above, $T_1$=20.34° C. (or 293.49K), $P_1$=4.051 bar, and $m_1$=81.83 grams, the calculation for the temperature of the pre-charged system is then:

$$T_2=5928*P_2/m_2 \quad \text{(Equation 16)}$$

where $P_2$ is the measured pressure of the pre-charged system in bar and $m_2$ is the mass, in grams, removed from the ISV tank during the pre-charge process.

Determining the temperature of the A/C system using the above method and the sensed A/C system pressure enables the average temperature of the A/C system to be accurately determined. Thus, the hose compensation value is more precise, and the error in the quantity of refrigerant charged into the A/C system is reduced.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

What is claimed is:

1. A method of operating a refrigerant service system to charge an air conditioning circuit, comprising:

pre-charging a predetermined pre-charge quantity of refrigerant into the air conditioning circuit;

determining an average temperature in the air conditioning circuit based upon a pressure in the air conditioning circuit after pre-charging the air conditioning circuit;

determining a charge compensation value based upon the determined average temperature in the air conditioning circuit; and charging the air conditioning circuit with a quantity of refrigerant based upon the charge compensation value.

2. The method of claim 1, further comprising:

obtaining a circuit charge quantity for the air conditioning circuit.

3. The method of claim 2, wherein the determination of the average temperature further comprises:

obtaining a pressure reading from a pressure transducer fluidly connected to the air conditioning circuit; and determining the average temperature in the air conditioning circuit based upon the pre-charge quantity of refrigerant, the circuit charge quantity, the pressure reading obtained from the pressure transducer, and baseline data stored in memory.

4. The method of claim 3, wherein the pre-charging further comprises:

operating a solenoid valve fluidly connected to and positioned between a refrigerant storage vessel and the air conditioning system to transfer the pre-charge quantity of refrigerant to the air conditioning circuit; and waiting for pressure to stabilize in the air conditioning circuit.

5. The method of claim 4, wherein the charging of the air conditioning circuit further comprises:

determining the quantity of refrigerant as the sum of the standard charge quantity and the charge compensation value; and operating the solenoid valve to charge the air conditioning circuit from the refrigerant storage vessel.

6. The method of claim 2, wherein the predetermined pre-charge quantity is less than half of the circuit charge quantity.

7. The method of claim 1, wherein the determination of the average temperature further comprises:

obtaining a first weight reading from a scale configured to sense a mass of a refrigerant storage vessel from which the pre-charge quantity is transferred prior to the pre-charging;

obtaining a second weight reading from the scale after the pre-charging;

determining an actual pre-charged quantity of refrigerant into the air conditioning system based upon the difference between the first and second weight readings;

obtaining a pressure reading from a pressure transducer fluidly connected to the air conditioning circuit; and determining the average temperature in the air conditioning circuit based upon the actual pre-charged quantity of refrigerant, the pressure reading obtained from the pressure transducer, and baseline data stored in memory from a baseline test.

8. The method of claim 7, further comprising:

obtaining a circuit charge quantity for the air conditioning circuit, wherein the determination of the average temperature in the air conditioning circuit is further based upon the circuit charge quantity.

9. The method of claim 7, wherein the baseline data includes a temperature value, a charge mass value, and a pressure value recorded from the baseline test.

10. The method of claim 1, wherein the charge compensation value is a compensation for an estimated quantity of refrigerant remaining in service hoses connecting the refrigerant service system to the air conditioning circuit after charging the air conditioning system.

11. A refrigerant service system, comprising:

a refrigerant storage vessel;

a hose connection configured to connect the refrigerant storage vessel to an air conditioning circuit; and a controller configured to operate the refrigerant service system to pre-charge a predetermined pre-charge quantity of refrigerant into the air conditioning circuit from the refrigerant storage vessel, determine an average temperature in the air conditioning circuit based upon a pressure in the air conditioning circuit after pre-charging the air conditioning circuit, determine a charge compensation value based upon the determined average temperature in the air conditioning circuit, and charge the air conditioning circuit from the refrigerant storage vessel with a quantity of refrigerant based upon the charge compensation value.

12. The refrigerant service system of claim 11, wherein the controller is further configured to obtain a circuit charge quantity for the air conditioning circuit.

13. The refrigerant service system of claim 12, further comprising:

a pressure transducer fluidly connected to and configured to generate a pressure reading corresponding to a pressure in the air conditioning circuit, wherein the controller is further configured to obtain the pressure reading from the pressure transducer and determine the average temperature in the air conditioning circuit based upon the pre-charge quantity of refrigerant, the circuit charge quantity, the pressure reading obtained from the pressure transducer, and baseline data stored in memory.

14. The refrigerant service system of claim 13, further comprising:

a solenoid valve fluidly connected to and positioned between the refrigerant storage vessel and the hose connection, wherein the controller is further configured to pre-charge the air conditioning circuit by operating the solenoid valve to transfer the pre-charge quantity of refrigerant to the air conditioning circuit and waiting for the pressure in the air conditioning circuit to stabilize.

15. The refrigerant service system of claim 14, wherein the controller is further configured to charge the air conditioning circuit by determining the quantity of refrigerant as a sum of the standard charge quantity and the charge compensation value, and operating the solenoid valve to charge the air conditioning circuit from the refrigerant storage vessel.

16. The refrigerant service system of claim 11, further comprising:

a scale configured to sense a mass of the refrigerant storage vessel; and a pressure transducer fluidly connected to and configured to generate a pressure reading corresponding to a pressure in the air conditioning circuit, wherein the controller is further configured to determine the average temperature by obtaining a first weight reading from the scale prior to the pre-charging, obtaining a second weight reading from the scale after the pre-charging, determining an actual pre-charged quantity of refrigerant into the air conditioning system based upon the difference between the first and second weight readings, obtaining the pressure reading from the pressure transducer, and determining the average temperature in the air conditioning circuit based upon the actual pre-charged quantity of refrigerant, the pressure reading obtained from the pressure transducer, and baseline data stored in memory from a baseline test.

17. The refrigerant service system of claim 16, wherein the controller is further configured to obtain a circuit charge quantity for the air conditioning circuit and to determine the average temperature in the air conditioning circuit based upon the circuit charge quantity.

18. The refrigerant service system of claim 16, wherein the baseline data includes a temperature value, a charge mass value, and a pressure value recorded from the baseline test.

19. The refrigerant service system of claim 11, wherein the charge compensation value is a compensation for an estimated quantity of refrigerant remaining in service hoses connecting the refrigerant service system to the air conditioning circuit after charging the air conditioning system.

20. The refrigerant service system of claim 11, wherein the predetermined pre-charge quantity is less than half of the circuit charge quantity.

* * * * *